US011940226B2

(12) United States Patent
Stiesdal

(10) Patent No.: US 11,940,226 B2
(45) Date of Patent: Mar. 26, 2024

(54) THERMAL ENERGY STORAGE SYSTEM WITH PHASE CHANGE MATERIAL AND METHOD OF ITS OPERATION

(71) Applicant: Stiesdal Storage A/S, Give (DK)

(72) Inventor: Henrik Stiesdal, Odense (DK)

(73) Assignee: Stiesdal Storage A/S, Give (DK)

( * ) Notice: Subject to any disclaimer, the term of this patent is extended or adjusted under 35 U.S.C. 154(b) by 0 days.

(21) Appl. No.: 18/282,629

(22) PCT Filed: Mar. 23, 2022

(86) PCT No.: PCT/DK2022/050055
§ 371 (c)(1),
(2) Date: Sep. 18, 2023

(87) PCT Pub. No.: WO2022/207047
PCT Pub. Date: Oct. 6, 2022

(65) Prior Publication Data

US 2024/0044585 A1 Feb. 8, 2024

(30) Foreign Application Priority Data

Mar. 31, 2021 (DK) ..... PA 2021 00337

(51) Int. Cl.
*F01K 3/12* (2006.01)
*F28D 20/02* (2006.01)
*F28D 20/00* (2006.01)

(52) U.S. Cl.
CPC ..... *F28D 20/02* (2013.01); *F01K 3/12* (2013.01); *F28D 2020/0082* (2013.01)

(58) Field of Classification Search
CPC ..... F01K 3/12; F28D 20/02; F28D 2020/0082
See application file for complete search history.

(56) References Cited

U.S. PATENT DOCUMENTS 9,841,243 B2 12/2017 Llena et al.
2010/0301614 A1 12/2010 Ruer
(Continued)

FOREIGN PATENT DOCUMENTS

EP 2594748 A1 5/2013
GB 2501685 A 11/2013
(Continued)

OTHER PUBLICATIONS

G. Zanganeh, "High-temperature thermal energy storage for concentrated solar power with air as heat transfer fluid," Dissertation submitted to ETH Zurich, Diss. ETH No. 21802, 2014, 168 pages.
(Continued)

*Primary Examiner* — Eric S Ruppert
(74) *Attorney, Agent, or Firm* — Elevated IP, LLC

(57) ABSTRACT

Thermal energy storage system with phase change material and method of its operation An energy storage system (100) comprises a hot thermal energy storage medium (5') and a cold thermal energy storage medium (4'), which are interconnected in a thermo-dynamic gas flow circuit. An energy converter with a motor/generator system (1A, 1B) is functionally connected to a compressor/expander system (2) for converting between electrical energy and thermal energy of the gaseous working fluid in the thermodynamic fluid circuit. A latent thermal energy storage working fluid is thermally connected to the gas flow circuit through heat exchanger (8) for providing a limit for the temperature in the cold TES medium (4').

17 Claims, 2 Drawing Sheets

(56) References Cited

U.S. PATENT DOCUMENTS

Figures 1A, 1B:
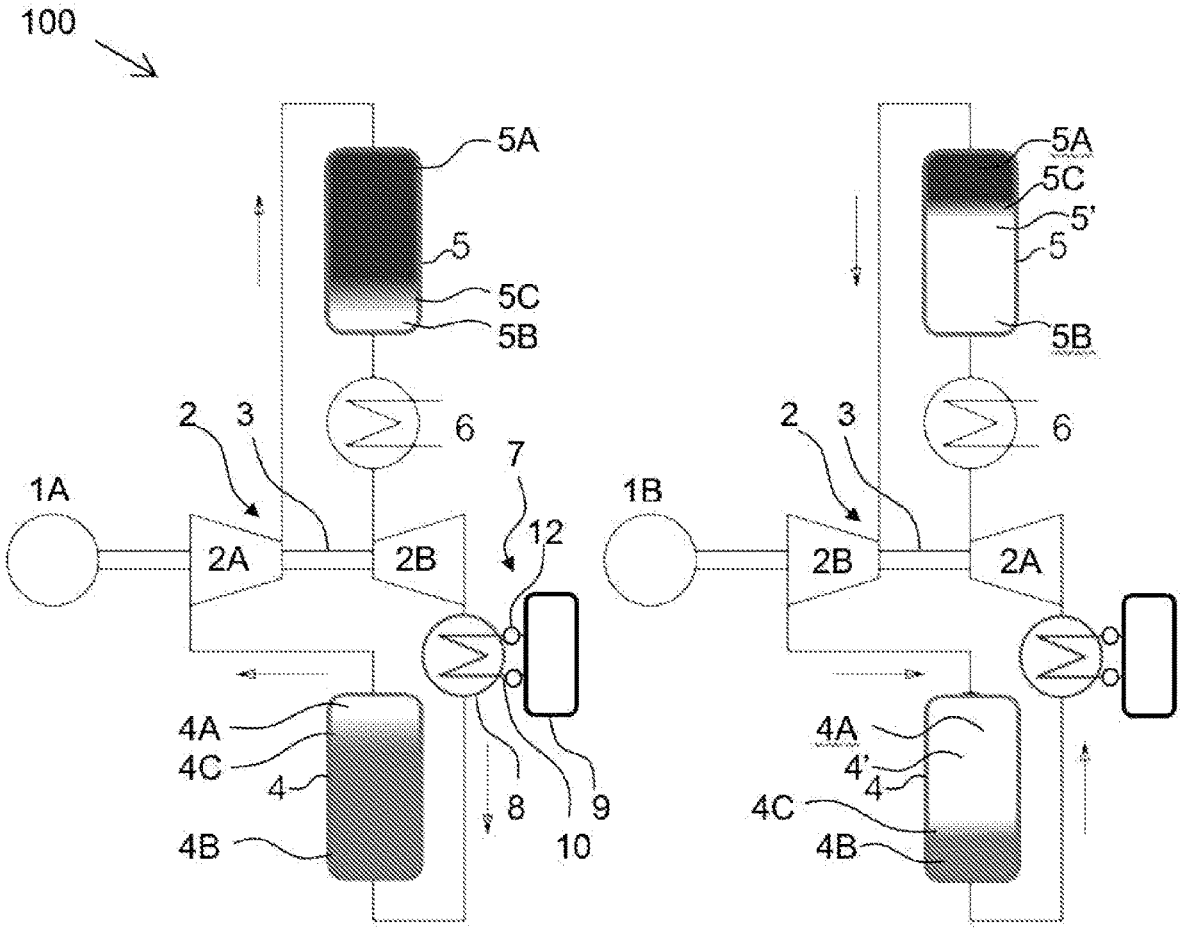

| | | | |
|---|---|---|---|
| 2014/0224447 | A1 | 8/2014 | Reznik et al. |
| 2016/0298498 | A1 | 10/2016 | Kreuger |
| 2017/0226900 | A1 | 8/2017 | Sanz et al. |

FOREIGN PATENT DOCUMENTS

| | | | |
|---|---|---|---|
| WO | 2009044139 | A2 | 4/2009 |
| WO | 2013102537 | A2 | 7/2013 |
| WO | 2013164563 | A1 | 11/2013 |
| WO | 2014036476 | A2 | 3/2014 |
| WO | 2014162129 | A1 | 10/2014 |
| WO | 2019013898 | A1 | 1/2019 |

OTHER PUBLICATIONS

R. Guedez et al., "Techno-economic performance evaluation of solar tower plants with integrated multi-layered PCM thermocline thermal energy storage—A comparative study to conventional two-tank storage systems," AIP Conference Proceedings 1734:070012, 2016, 10 pages.

THERMAL ENERGY STORAGE SYSTEM WITH PHASE CHANGE MATERIAL AND METHOD OF ITS OPERATION

CROSS-REFERENCE TO RELATED APPLICATIONS

This application is a 371 national stage application of International Patent Application No. PCT/DK2022/050055, filed Mar. 23, 2022, which claims the benefit of and priority to Danish Application No. PA 2021 00337, filed Mar. 31, 2021, each of which is hereby incorporated by reference in its entirety.

FIELD OF THE INVENTION

The present invention relates to energy storage by conversion between electrical and thermal energy. In particular, it relates to a system and method for an energy storage system with a thermodynamic circuit according to the preamble of the independent claims.

BACKGROUND OF THE INVENTION

Sustainable electricity production by wind and solar power suffers from the fact that electricity is not necessarily demanded at the time of production and not necessarily available at the time of demand. Accordingly, various energy storage facilities have been proposed, where the electrical energy is transformed into heat and stored until there is a demand for transforming it back into electricity.

International patent application WO2009/044139 discloses a system comprising a first thermal energy storage (TES) container and a second TES container at a lower temperature, which are interconnected through a compressor/expander arrangement for increasing or decreasing the temperature in the first TEC container during charging or discharging of the system, respectively. When there is surplus electricity, a compressor is driven by an electrical engine, increasing the temperature of gas by compression, which is then used to heat a TES medium in the form of a bed of gravel in the first TES container. When there is a demand for electricity, the compressed hot gas is released from the first TES container through an expander which drives an electrical generator for recovering the electrical energy.

During charging and discharging processes, a thermal front between hot and cold regions moves through the TES container from one end towards the other due to the gradual temperature changes in the TES container. During such movements of the thermal front, especially when the charging/discharging process is repeated, the temperature gradient tends to flatten between the two ends of the storage container, which is called thermocline degradation. Thermocline degradation is an effect of the temperature transition zone, also called thermocline zone or thermocline region, becoming wider. Thermocline degradation is not wanted because it decreases the overall efficiency of the system. Various methods have been proposed for counteracting such thermocline degradation by steepening the gradient and reducing the width of the thermocline zone.

The system of WO2009/044139 implies another problem when applied in practice, namely the fact that the specific heat capacity for the gravel decreases with temperature, so that the cold storage container needs more gravel than the hot storage container in order to balance correctly. When having in mind that costs for energy storage systems are sensitive on container sizes, this appears not optimum.

Alternative systems use phase change materials (PCM) in TES systems, which control the temperature at one end or both ends of the TES containers. An advantage of such systems is a better control of the thermocline.

Use of PCM is discusses and illustrated in the article, "Techno-economic Performance Evaluation of Solar Tower Plants with Integrated Multi-layered PCM Thermocline Thermal Energy Storage—A Comparative Study to Conventional Two-tank Storage Systems." by Guedez et al., presented at SolarPACES 2015, AIP Conf Proc. 1734, 070012-1-070012-9; doi: 10.1063/1.4949159 and published in ATP Publishing. 978-0-7354-1386-3.

Examples of PCM in TES containers are disclosed in U.S. Pat. No. 9,841,243, where the PCM is provided in one end, but preferably in both ends, of the TES container.

Various examples of multilayer PCM and its influence on the thermocline are discussed in US2017/226900. As a PCM, paraffin is proposed with a melting temperature of 130° C. In order to prevent the paraffin from melting and solidifying into a solid mass, which would prevent the gas from traversing the PCM, the paraffin is encapsulated and provided as a granular material.

However, this leads to a discussion of a general problem related to encapsulated particulate PCM. If the granules are too small, the PCM implies high costs, and the volume of the PCM relatively to the volume of the heat transferring encapsulation becomes too small for practical large-scale applications. On the other hand, if the granules are too large, the thermal transfer into the PCM material is not adequate, which also poses difficulties with respect to practical applications, especially when the criteria incudes commercial aspects, such as costs for construction and maintenance as well as long-term profitability.

WO2014/036476 discloses combinations of sensible TES containers and latent TES containers, for example ice slurry container. In particular, it discloses a thermodynamic circuit comprising a sensible TES container with granules for increased heat capacity and a latent heat container and a two-phase working fluid flowing serially through these containers, the working fluid being condensed and vaporized depending on the position in the circuit. The two-phase working fluid undergoes condensation at ambient temperature while exchanging energy with the surroundings. When the working medium is in the liquid phase, it is pumped by a pump between the sensible and the latent TES container, the direction of pumping dependent on whether the process is for charging or discharging. On the opposite side of the TES containers, relatively to the position of the pump in the circuit, the working fluid is in the gas phase and flowing through a compressor/expander for receiving or delivering energy, respectively. Also disclosed is an embodiment in FIG. 14, which in a discharge mode has a latent TES container downstream of an expander and upstream of a pump which in turn is upstream of a sensible TES container. Downstream of the sensible TES container is a heat exchanger system for heat exchange with ambient temperature. Accordingly, the temperature range of the sensible TES container is between ambient temperature $T_a$ and a colder temperature $T_C$. It also discloses a hot storage circuit where the latent heat storage is used upstream of the sensible heat storage during charging, where the latent TES container is between the compressor and the sensible heat storage. The examples are primarily designed for heat exchange with the environment and temperature variations between ambient temperature and working fluid having a temperature varying between ambient temperature and a lower or higher temperature. Although, a large number of variations are disclosed, these do not have the flexibility of thermodynamic gas circuits with two sensible TES containers.

Combinations of sensible TES containers for cooling a cooling chamber to cryogenic temperatures for superconductors is disclosed in WO2013/164563A1. The circuit is extracting heat from the cooling chamber both during charging and discharging periods.

In general, there is still a need for improvement with respect to optimization of energy storage systems.

DESCRIPTION/SUMMARY OF THE INVENTION

It is therefore an objective of the invention to provide an improvement in the art. In particular, it is an objective to provide a thermal energy storage (TES) system and a method of operating it, which optimizes the system not only with respect to thermocline control, where the temperature gradient in the thermocline zone is kept steep, but also with respect to general efficiency and cost optimization. This objective and further advantages are achieved with a system and method as described below and in the claims.

In simple term, the invention provides a method of operating an energy storage system, the system comprising a hot thermal energy storage medium and a cold thermal energy storage medium, which are interconnected in a thermodynamic circuit with gas as a working fluid, and an energy converter with a motor/generator system functionally connected to a compressor/expander system for converting between electrical energy and thermal energy of the working fluid in the thermodynamic fluid circuit. Ice slurry as a latent TES working fluid is thermally connected to the thermodynamic circuit for providing a lower limit for the temperature in the cold TES medium.

The latent TES working fluid is a phase change material, PCM, which during operation of the system is in two-phase form, namely liquid with ice, which is fluidic due to the ice being in small crystals inside the liquid, so that it can be pumped by a pump. This is commonly also called ice slurry.

By providing such transfer of heat between the gaseous sensible working fluid and the ice slurry as latent working fluid, a number of advantages are achieved:

- the temperature of the gaseous working fluid can be kept at a controlled predetermined zero or sub-zero level above the temperature of the gas at the expander outlet;
- energy can be stored at low temperature without the requirements of large quantities of gravel in the cold storage container;
- the thermocline is controlled, and flattening of the gradient is counteracted, implying high efficiency of the thermodynamic circuit;
- the transfer of thermal energy to the ice slurry is more efficient than with a stationary PCM because the ice slurry is moving in conduits through the heat exchanger and thus efficiently mixed by turbulence, implying an almost instant temperature equalization throughout the conduits of the latent flow path, for example as a circuit, resulting in optimal energy transfer;
- the PCM system is suitable as a simple selectable add-on feature during the design phase of the TES system, making design with or without PCM easier than incorporation of the PCM in the TES containers;
- the PCM system is suitable as a retrofit addition for already existing TES systems.

As it appears from the above, the proposed configuration has a number of benefits. Details of the system are explained in the following.

In the thermal energy storage, TES, system with a thermodynamic circuit, a gaseous working fluid is used, for example dried air. Throughout the entire thermodynamic gas flow circuit, the working fluid remains in the gas phase and does not change into liquid phase.

As parts of the gas flow circuit, a first sensible TES container is provided, which contains a first TES medium, and a second sensible TES container is provided, which contains a second TES medium. Each TES container has a top and a bottom and contains its respective TES medium therein between for storing thermal energy, the TES medium in each container having an upper end and a lower end.

During charging and discharging cycles, the first TES medium has a temperature range higher than the second TES medium. However, the temperature of the lower end of the first TES medium is typically lower than the temperature in the upper end of the second TES medium. For example, the temperature range in the first TES medium is 50-100° C. at the bottom and 500-700° C. at the top, whereas the temperature range in the second TES medium is −20° C. to 0° C. at the lower end and 350-450° C. at the top, In order for the gas to flow through the TES medium, it is advantageously gas permeable. For example, the TES medium is gravel, such as granite gravel or other types of stone material. Such materials are available at low costs and commonly used in TES systems. Also, the heat transfer from the gas to the gravel is efficient, especially if the gravel has a particle size of less than 10 mm. Although, in principle, the gas can also flow in tubes through the TES medium, making it possible to use compact or liquid TES media, this is often not preferred due to the lower thermal transfer efficiency.

For input and extraction of electrical energy, an energy converter is inserted into the circuit. On the one hand, it converts electrical energy to thermal energy that is added the gaseous working fluid in the thermodynamic fluid circuit during charging and, on the other hand, converts thermal energy to electrical energy during discharging. For this, the energy converter comprises an electrical motor/generator system with a motor and a generator, and comprises a compressor/expander system with a compressor and an expander. The electrical motor of the motor/generator system is used for driving a compressor, for example turbo compressor, of the compressor/expander system for adding energy to the circuit by compressing the gas in the charging phase and thereby increasing the temperature of the gas. The generator is used for producing electricity in the discharge phase, where the generator is driven by the expander of the compressor/expander system when hot gas is expanding in the expander during a discharging phase.

In some practical embodiments, turbines are used as compressor and expander. Alternatively, other types of compressor and expander are used, for example a piston compressor and a piston expander. A shaft to the compressor is driven by the electric motor during charging, and a shaft form the expander is driving the electric generator during discharging, for storing and recovering electrical energy, respectively. Typically, the compressor and the expander are interconnected by a rotational shaft for synchronous rotational motion, and the same shaft may serve to connect to the motor and/or generator.

In operation, the top of the first TES container and the top of the second TES container are interconnected through the compressor during charging and through the expander during discharging. The bottom of the first TES container and the bottom of the second TES container are interconnected through the compressor during discharging and through the expander during charging. The connections provide a gas flow circuit for the gaseous working fluid in one way through the TES containers during charging and in the opposite way during discharging.

Additionally, a latent TES system is provided. The latent TES system comprises a latent flow path, for example circuit, containing a latent working fluid that is in liquid phase but not in gas phase in the latent TES system. During operation, the latent working fluid comprises both liquid and solids as an ice slurry that is kept fluidic by turbulence in order for it being able to be pumped through the latent flow path. During uptake or extraction of thermal energy by the latent TES system, the solid fraction in the slurry decreases or increases, respectively.

In some practical embodiments, the TES system comprises a latent TES container, tubing and a pump for transporting the latent working fluid through the latent TES system.

Water ice slurry is a useful latent working fluid due to a high thermal capacity and low price. Optionally, the freezing point of the latent working fluid is adjusted by an additive, for example salt, sugar, or glycol, the latter being ethylene glycol or propylene glycol, depending on various criteria, such as viscosity and toxicity.

A heat exchanger is arranged in the gas flow circuit between the compressor/expander system and the bottom of the second TES container. The heat exchanger is separating the latent working fluid from the gaseous working fluid by a thermally conducting wall. During operations, thermal energy is exchanged through the thermally conducting wall between the gaseous working fluid in the gas flow circuit and the latent working fluid in the latent flow path. The term "thermally conducting wall" should be read as also comprising multiple of such walls in the heat exchanger, for example multiple adjacent canals for efficient transfer of heat.

In operation, during a charging period, the tops of the first and second TES containers are connected through the compressor, and the bottoms are connected through the expander. When driving the compressor/expander system by the electric motor, the gaseous working fluid from the top of the second TES container is received by the compressor and adiabatically compressed for increasing the temperature of the gaseous working fluid. For example, the compressor is raising the temperature of the gas during the charging to a temperature above 400° C., optionally to a temperature in the range of 400° C. to 600° C. As the gas is taken from the top of the second TES container and the temperature raised further by the compressor, the temperature downstream of the compressor is always higher than the temperature in the second TES container during charging.

The hot gas from the compressor is provided into the top of the first TES container and transfers heat to the first TES medium during its way from the top to the bottom of the first TES container. After that, the gas is received by the expander and adiabatically expanded, which decreases the temperature of the gas prior to its way through the heat exchanger where thermal energy is transferred to the gas from the latent working fluid. Subsequently, the gas is supplied to the bottom of the second TES container and makes its way from the bottom to the top through the second TES medium where it takes up thermal energy from the second TES medium.

As the latent working fluid during operation of the system, especially ice slurry, has a constant temperature, it sets a lower limit of the gas temperature when supplied to the second TES medium. For example, the temperature $T_0$ of the ice slurry is in the range of −20° C. and 0° C., which can be adjusted in water ice slurry by an additive, such as ethylene or propylene glycol. The freezing temperature of water can be lowered by increasing the fraction of the glycol additive. However, due to the specific heat capacity of the gravel decreasing with decreasing temperature, its TES capabilities are decreasing at lower temperature, so that the temperature of the second TES medium should not be decreased substantially below 0° C. Accordingly, the phase change temperature of −20° C. for the latent working fluid is a useful lower limit for most operations of the thermodynamic system.

For example, during charging, the heat exchanger raises the temperature of the gas from the expander, which leaves the expander with a gas temperature $T_e$, by at least 15° C., or in other words $T_e$ is at least 15° C. lower than the temperature $T_0$ of the ice slurry. For example, the gas at the exit of the expander has a temperature $T_e$ in the range of −25° C. to −45° C., such as in the range of −30° C. to −40° C., and is then heated to a temperature $T_0$ in the temperature range of −20° C. to 0° C., for example in the range of −5° C. to 0° C., or even to 0° C., in the heat exchanger, before it is supplied to the bottom of the second TES container.

In some practical embodiments, the latent TES system comprises a first tank and second tank interconnected by the latent flow path for flow of the latent working fluid between the first tank and the second tank, typically only through the heat exchanger. The first tank comprises the latent working fluid at a temperature above its freezing point, for example above zero, and the second tank comprises ice slurry of the latent working fluid during operation. During charging, the latent working fluid flows from the first tank through the heat exchanger to the second tank, advantageously in counterflow with the gas flow through the heat exchanger, and thermal energy is transferred from the water to the gas in the heat exchanger, forming ice slurry by the thermal energy transfer. During discharging, the flow is reversed, and the ice slurry from the second tank pumped through the heat exchanger, heated therein by the gas, and then pumped back into the first tank and stored therein at a temperature above the freezing point, for example above 0° C.

For example, the temperature in the first water tank is kept at ambient temperature by using heat exchange with the environment.

Alternatively, the latent TES system comprises an ice slurry tank, and the latent flow path is a latent flow circuit from the tank to and through the heat exchanger and back to the tank. During charging, the latent working fluid is pumped from the tank through the heat exchanger, advantageously in counterflow with the gas through the heat exchanger, and back to the tank in a circuit during charging and during discharging. During charging and discharging, typically, the latent flow is reversed.

During a discharging period the flow direction in the gas flow of the gas flow circuit is reversed. In this case, the tops of the first and second TES containers are connected through the expander and the bottoms through the compressor. The gas from the top of the first TES container is received by the expander and drives the expander as well as the generator during adiabatic expansion of the hot gas towards the low temperature section of the circuit. The gaseous working fluid from the expander is guided into the top of the second TES container and through the second TES medium for transferring thermal energy from the gaseous working fluid to the second TES medium during its way from the top to the bottom of the second TES container. Then, the gaseous working fluid flows from the bottom of the second TES container through the heat exchanger and transfers thermal energy to the latent working fluid. During the discharge process, the temperature of the gas after having traversed the second TES medium increases gradually with time, and so does the transfer of thermal energy from the gas to the latent working fluid. Downstream of the heat exchanger, the gas is received and adiabatically compressed by the compressor, which increases the temperature of the gas. The compressed gas is received at the bottom of the first TES container for transfer of further thermal energy from the first thermal medium to the gaseous working fluid during its flow towards the top of the first TES container, which completes the discharge cycle.

The pressure in the first TES container and in the pipe system above the compressor/expander system is higher than the pressure in the second TES container and in the pipe system below the compressor/expander system. Accordingly, the region of the thermodynamic circuit above the compressor/expander is a high pressure region, and the region of the thermodynamic circuit below the compressor/expander system is a low pressure region.

The section between the tops of the TES containers has a temperature higher than the section between the bottoms of the TES containers, why the section between the tops of the TES containers is called a high temperature section of the thermodynamic circuit, and the section between the bottoms of the TES containers is called a low temperature section of the thermodynamic circuit.

As it appears, the latent TES system is a simple add-on to existing thermodynamic circuits and improves the efficacy in two ways. On the one hand, the improvement is achieved by counteracting detrimental flattening of the gradient in the TES container. On the other hand, it sets a lower limit for the gas temperature when supplied to the cold second TES medium, avoiding the low-temperature regime in which the specific heat capacity of the second TES medium is low. The latter is important, as the use of a temperature range where the specific heat capacity of the second TES medium is high allows minimization of the amount of the second TES medium in the second TES container. This, in turn, reduces costs, seeing that large proportions of construction costs are used for the containers.

In experiments, providing the exchange of thermal energy between the gas and the latent working fluid only by heat exchange in the flow circuit between the energy converter and the bottom of the second TES container has been proven sufficient for high efficiency. Accordingly, in some embodiments, such latent TES system is the only latent TES system in thermal connection with the thermodynamic gas circuit.

Due to the increase of efficiency by such simple latent add-on system, the TES containers can be kept free from latent heat storage and only contain sensible TES media in.

However, it may be useful to provide a further heat exchanger in the gas flow circuit between the bottom of the first TES container and the compressor/expander system. In some further embodiments, the further heat exchanger exchanges thermal energy between the gas and a fluid flowing through the further heat exchanger for changing the temperature in the fluid. For example, heat is provided to such fluid, optionally water, for heating purposes, such as in a heat distribution network for dwellings.

SHORT DESCRIPTION OF THE DRAWINGS

The invention will be explained in more detail with reference to the drawing, where FIG. 1 illustrates a principle sketch of an energy storage system in A) charging cycle and B) discharging cycle;

FIG. 2 illustrates an alternative embodiment in A) charging cycle and B) discharging cycle.

DETAILED DESCRIPTION/PREFERRED EMBODIMENT

FIG. 1A illustrates a principle sketch of a thermal energy storage (TES) system 100 during a charging cycle, and FIG. 1B in a corresponding discharging cycle.

The system 100 comprises an electrical motor/generator system with an electrical motor 1A and an electrical generator 1B, shaft-connected to a compressor/expander system 2 with a compressor 2A and an expander 2B, connected by a common rotational shaft 3, for example a co-functional compressor/expander unit.

The system 100 also comprises a first thermal energy storage (TES) container 5 containing a first gas-permeable TES medium 5', and a second TES container 4 containing a second gas-permeable TES medium 4'. For example, the medium is gravel.

The working fluid is gaseous throughout the circuit.

With reference to FIG. 1A, during charging, the motor 1A drives the compressor 2A for compressing the gaseous working fluid by the compressor 2A, where the gaseous working fluid is taken from the top of the second TES container 4. The temperature of the gaseous working fluid from the second TES container increases adiabatically by the compression in the compressor 2A, and the hot gaseous working fluid from the exit of the compressor 2A is added to the top of the inner volume of the first TES container 5 for heating the first TES medium 5', for example gravel, inside the first TES container 5.

While the compressed gas flows through the first TES medium 5' from top to bottom in the first TES container 5, it heats up the contained first TES medium 5', first in the top and subsequently further down. During the charging, the size of the hot-temperature volume 5A of the first TES medium 5' that has already attained the temperature of the compressed gas increases gradually with time, so that the heated hot-temperature volume 5A expands downwards in the first TES container 5 by which the low-temperature volume 5B of the first TES medium 5' correspondingly decreases.

For example, the temperature of the compressed gas is in the range of 500° C. to 700° C., which will be the temperature at the top of the first TES container 5 at the start of the charging. While the gas traverses the first TES container 5 it is cooled by thermal transfer to the first TES medium 5' inside the first TES container 5 and leaves the bottom of the first TES container at a lower temperature, for example in the range of 50-100° C. during the start of the charging period. It expands in the expander 2B, which cools the gas further down, for example to a temperature $T_e$ in the range of −25° C. to −45° C.

After the expander 2B, the gas enters the bottom of the second TES container 4 and passes the second TES medium 4' in the second TES container 4 on its way from the bottom to the top, so that it gets heated, for example to a temperature in the range of 350° C. to 450° C. during its way through the second TES medium 4' from the bottom to the top, after which it enters the circuit again. The low-temperature volume 4B of the second TES medium 4' increases during this process, while the high-temperature volume 4A in the second TES container 4 decreases correspondingly during the charging process.

Between the high-temperature volume 5A and the low-temperature volume 5B in the first TES container 5, the temperature transition region 5C with the temperature gradient from the high to the low temperature is called the thermocline zone. Similarly, the transition region with the thermocline zone 4C between the high-temperature volume 4A and the low-temperature volume 4B of the second TES medium 4' in the second TES container 4 is called a thermocline zone. These transition regions or thermocline zones 4C, 5C are desired narrow with a steep gradient.

As a measure for improving the efficiency, a heat exchanger 6 is provided in order to transfer heat to an external fluid. For example, the heat received by the heat exchanger 6 is used for heating dwellings. It may also be stored for later return to the circuit.

The charging process is done when surplus electricity is available in the electricity system, for example from a solar power plant or wind turbines or from a more conventional electricity production plant using fossil fuel. The electricity drives the motor 1A for the compressor/expander 2 during the charging process.

The pressure in the first TES container 5 and in the pipe system above the compressor/expander system 2 is higher than the pressure in the second TES container 4 and in the pipe system below the compressor/expander 2. Accordingly, the region of the thermodynamic circuit above the compressor/expander 2 is a high pressure region, and the region of the thermodynamic circuit below the compressor/expander 2 is a low pressure region. The section between the tops of the TES containers 4, 5 has a temperature higher than the section between the bottoms of the TES containers, why the section between the tops of the TES containers is called a high temperature section of the thermodynamic circuit, and the section between the bottoms of the TES containers is called a low temperature section of the thermodynamic circuit.

Once, the charging process has been finished, the thermal energy is stored until a demand for electricity is present, and discharging starts with a gas flow in the opposite direction. During discharging, the hot gas from the first TES container 5A is leaving the container 5 at the top and is adiabatically expanding in the expander 2B towards the low-pressure in the second TES container 4. The expander 2B drives the generator 1B to produce electricity, for example for giving it back to the electricity grid for general consumption. The expansion of the hot gas in the expander 2B leads to cooling of the gas. The cooled gas is then supplied to the top of the second TES container 4 in which it is further cooled by thermal transfer to the second TES medium 4' on its way to the bottom. The cold gas leaves the second TES container 4 at the bottom and is, after compression in the compressor 2A and corresponding increase of temperature, added to the bottom of the first TES container 5 where it is heated up by the first TES medium 5' during its flow from the bottom to the top of the first TES container 5.

Notice that the gas as working fluid is not undergoing a phase shift into liquid in this circuit.

This just described circuit suffers from some shortcomings if it is provided without a latent TES system 7, which is described in more detail in the following. These shortcomings are as follows. Firstly, as already discussed, the temperature gradient is advantageously maintained steep in the transition regions 4C and 5C, which contain the thermocline. However, as discussed in the introduction, it is a common risk that the thermocline degrades during the charge and discharge, especially during repeated cycles. When the thermocline zones 4C, 5C moves through the respective container 4, 5, the thermocline tends to flatten. Secondly, as mentioned above, although gravel is a useful material for large-scale heat storage facilities due to its low cost, gravel has the disadvantageous property of the specific heat capacity decreasing with decreasing temperature. Accordingly, heat exchange at very low temperatures, for example at a temperature $T_e$ of −35° C., is not optimum due to the decreased heat capacity. Due to the heat capacity decreasing with temperature, the second TES container 4 would need more gravel relatively to the first TES container 5 in order to create a thermal storage balance between the two containers in the circuit.

In order to optimize the system with respect to thermocline control and with respect to reduction of the content of gravel in the second TES container, the following technical solution has been found very useful.

In this technical solution, a latent TES system 7 is provided. The latent TES system 7 comprises a heat exchanger 8 located in the flow connection between the compressor/expander system 2 and the bottom of the second TES container 4. Inside the heat exchanger 8, a thermal conducting wall separates the two fluids, of which one is the gaseous working fluid in the gas flow cycle and the other fluid is a latent TES working fluid. In particular, the latent working fluid is ice slurry during operation of the system. Due to the pumping of the ice slurry through the heat exchanger 8, the ice slurry is subject to turbulence, which prevents the liquid, for example water, to freeze into a block.

In order to adjust the freezing temperature of the water, the water optionally contains ethylene glycol or propylene glycol, the amount of which regulates the freezing temperature. Alternatives for adjusting the freezing point are various sugar or salts, including but not limited to sodium chloride, calcium chloride, or potassium carbonate.

Optionally, the heat exchanger 8 is flow-connected to a storage tank 9 of a size adjusted to the latent energy that is intended to be stored. A pump 12 drives the latent working fluid through a connecting tubing system 10. The storage tank 9 advantageously has a stirrer and/or scraper in order to prevent formation of ice blocks and to maintain ice and liquid in the form of ice slurry. Such a system can be easily enlarged by adding tanks according to the need of total volume of latent working fluid.

Due to the ice slurry, the temperature in the bottom of the second TES container can be kept near the freezing point of the ice slurry, the freezing point potentially adjusted by additives. As the freezing point is kept at constant temperature substantially above the temperature $T_e$ at the expander outlet during charging, for example near or at 0° C., the thermocline is controlled efficiently and kept steep. Additionally, the heat exchanger also assists in maintaining a steep thermocline in the first TES container, as the temperature of the gas that is supplied to the first TES container during discharging is determined by the temperature in the heat exchanger 8.

Importantly, the specific heat capacity of the gravel is kept relatively high so that the amount of gravel can be kept much smaller than in a comparative system where the temperature in the cold storage tank is far below 0° C. As an example that was mentioned above, the gas temperature downstream of the expander during charging may be as low as −35° C., where the specific heat capacity of gravel is very low.

The addition of a heat exchanger 8 for a latent TES system 7 is useful in that it can be provided as an add-on feature during retrofit of already existing systems. As the PCM is not added inside any of the sensible TES containers 4, 5, such add-on is very simple, only requiring an insertion in the tubing between the compressor/expander system 2.

The above example is valid if the heat exchanger due to the flow of the ice slurry is efficient to increase the temperature of the gas from the expander 3 to the freezing temperature of the ice slurry. Otherwise, the gas temperature at the exit side of the heat exchanger will be lower than the freezing point. For this reason, a good thermal transfer should be maintained.

One of the means to maintain a good thermal transfer is turbulence of the ice slurry, which ensures that thermal anergy is brought to the heat exchanger constantly at a sufficient rate during flow through the heat exchanger. Turbulence, as well as a certain amount of glycol additive may additionally prevent the water from freezing to the walls of the heat exchanger.

Optionally, in order to further prevent the ice to stick to the wall of the heat exchanger, the surface is provided with a non-stick coating. An example of a useful ice-nucleation non-stick coating as described in U.S. Pat. No. 8,371,131. It discloses a polymer coating comprising polar nucleation points in a non-polar matrix, where water freezes at the nucleation points but does not stick to the surface due to the non-polar matrix and because waterflow steadily removes the ice from the nucleation points. As it reads in U.S. Pat. No. 8,371,131, the non stick properties also work for water that contains glycol.

When the system is in discharging mode, as illustrated in FIG. 1B, the gas from the lower end of the second TES container 4 will attain the same temperature as the ice slurry prior to entering the compressor 2A.

The system in FIG. 1 provides a largely fixed temperature to the gas at the exit side of the heat exchanger, due to the latent system, subject to efficient heat transfer between the gas and the ice slurry in the heat exchanger 6.

However, it is also possible to use an ice slurry system for raising the temperature higher than the freezing temperature. An example is given with reference to FIG. 2.

Figures 2A, 2B:
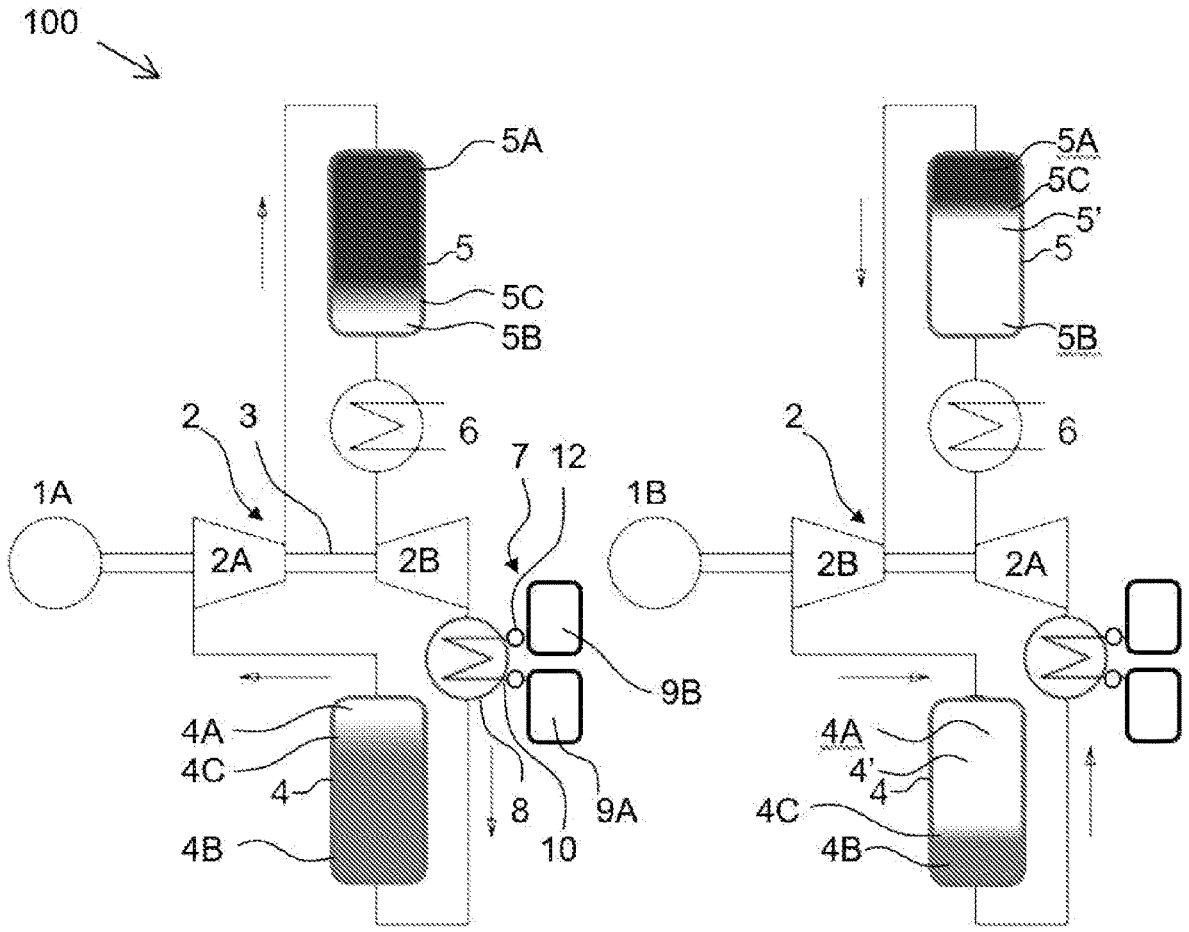

FIG. 2A illustrates a further embodiment in charging conditions and FIG. 2B in discharging conditions. The components are the same as in FIG. 1 apart from the facts that the ice slurry container 9 of FIG. 1 has been exchanged by two water tanks 9A and 9B, where the water in the first water tank 9A is at a temperature $T_{high}$ above the freezing point of the water. The water is potentially containing an additive for adjusting the freezing temperature. The water in the second water tank 9B is at a temperature $T_0$ which is at the freezing temperature of the water or water/glycol mix.

For example, the temperature $T_{high}$ in container 9A is kept at ambient temperature, optionally by a using a heat exchanger (not shown) that is exchanging heat with the environment. For example, the environment is at 20° C.

When in the charging mode, the cold gas at the exit of the expander 2B, optionally at a temperature $T_e$=−35° C., is gradually heated from $T_e$ to $T_{high}$, for example $T_{high}$=20° C., while the gas is flowing through the heat exchanger 8 in counterflow with the water and receiving thermal energy from the water flowing from the first tank 9A through the heat exchanger 8 into the second tank 9B. The heated gas will flow from the heat exchanger 8 to the bottom of the second TES container 4, while the gas is at the temperature $T_{high}$. Accordingly, the minimum temperature in the second TES container is kept at $T_{high}$ above the freezing point of the water, potentially water/glycol mix, This is advantageous in that the specific heat capacity of the TES medium 4', especially gravel, in the second TES container is kept high as compared to sub-zero temperatures $T_0$.

The water leaving the heat exchanger 8 towards the second tank 9B will have given thermal energy to the gas of the gas flow circuit when the gas flowing through the heat exchanger 8, which lowers the temperature of the water. For an efficient heat exchanger 8, the water is frozen to ice slurry and is at the exit of the heat exchanger at the freezing temperature. Thus, the second tank 9B contains water at $T_0$ which is at the freezing temperature of the water, potentially with additives.

When in the discharging mode, as illustrated in FIG. 2B, the gas from the lower end of the second TES container 4 is flowing at a temperature higher or equal to $T_{high}$ through the heat exchanger 8 and will attain the temperature of the ice slurry, which is pumped back from container 9B into container 9A in counterflow with the gas through the heat exchanger 8.

Also this system improves the efficiency by counteracting flattening of the gradient in the TES container and sets a lower limit for the gas temperature when supplied to the cold second TES medium, avoiding the low-temperature regime in which the specific heat capacity of the second TES medium is low.

The invention claimed is:

1. A method of operating a thermal energy storage, TES, system having a thermodynamic gas flow circuit including:

a gaseous working fluid that is not in liquid phase but maintained in gas phase throughout the gas flow circuit;

a first TES container, wherein the first TES container has a top and a bottom and contains a first TES medium for storing thermal energy, the first TES medium having an upper end and a lower end, a second TES container, wherein the second TES container has a top and a bottom and contains a second TES medium for storing thermal energy, the second TES medium having an upper end and a lower end, an energy converter for converting between electrical energy and thermal energy of the gaseous working fluid in the gas flow circuit; the energy converter comprising an electrical motor, an electrical generator, and a compressor/expander system, the compressor/expander system comprising a compressor and an expander, wherein the compressor is functionally connected to the motor for being driven by the motor during a charging period, and the expander is functionally connected to the generator for driving the generator during a discharging period;

the method comprising, during a charging period:

interconnecting the top of the first TES container and the top of the second TES container through the compressor and the bottom of the first TES container and the bottom of the second TES container through the expander, driving the compressor by the electric motor, receiving the gaseous working fluid from the top of the second TES container by the compressor, and adiabatically compressing the gaseous working fluid by the compressor for increasing a temperature of the gaseous working fluid, providing the compressed gaseous working fluid into the top of the first TES container and through the first TES medium for transferring heat from the gaseous working fluid to the first TES medium during movement of the gaseous working fluid from the top of the first TES container to the bottom of the first TES container, receiving the gaseous working fluid from the bottom of the first TES container by the expander and adiabatically expanding the gaseous working fluid for decreasing the temperature of the gaseous working fluid, after the expansion, receiving the gaseous working fluid by the bottom of the second TES container, and by flow through the second TES medium towards the top of the second TES container transferring thermal energy from the second TES medium to the gaseous working fluid;

the method comprising, during a discharging period:

interconnecting the top of the first TES container and the second TES container through the expander and the bottom of the first TES container and the second TES container through the compressor, receiving the gaseous working fluid from the top of the first TES container by the expander and driving the generator for producing electrical power by work from the expander due to adiabatic expansion of the gaseous working fluid through the expander, guiding the gaseous working fluid from the expander into the top of the second TES container and through the second TES medium for transferring thermal energy from the gaseous working fluid to the second TES medium during movement from the top of the second TES container to the bottom of the second TES container, receiving and adiabatically compressing the gaseous working fluid by the compressor, after the compression, receiving the compressed gaseous working fluid at the bottom of the first TES container for transfer of thermal energy from the first thermal medium to the gaseous working fluid during its flow towards the top of the first TES container;

wherein the system comprises a latent TES system including:

a latent fluid flow path containing a latent working fluid that comprises a phase change material, a heat exchanger located in the gas flow circuit between the compressor/expander system and the bottom of the second TES container, the heat exchanger separating the latent working fluid from the gaseous working fluid by a thermally conducting wall for exchange of thermal energy between the gaseous working fluid in the gas flow circuit and the latent working fluid in the latent flow path;

a pump for pumping the phase change material through the heat exchanger and creating turbulence in the phase change material during the transfer of the thermal energy in the heat exchanger;

wherein the method further comprises:

during the charging period, after adiabatic expansion of the gaseous working fluid by the expander, guiding the gaseous working fluid through the heat exchanger and transferring thermal energy from the latent working fluid to the gaseous working fluid for increasing the temperature of the gaseous working fluid before receiving the gaseous working fluid by the bottom of the second TES container, wherein the phase change material is in the form of ice slurry during operation of the system and the method comprises:

during the discharging period, guiding the gaseous working fluid from the bottom of the second TES container through the heat exchanger and transferring thermal energy from the gaseous working fluid to the latent working fluid prior to the adiabatic compression by the compressor.

2. The method according to claim 1, wherein the latent working fluid comprises water as the phase change material and the method comprises forming water ice slurry during operation.

3. The method according to claim 2, wherein the latent working fluid comprises an additive for adjusting the freezing point of the water ice slurry.

4. The method according to claim 2, wherein the latent TES system comprises a first tank and second tank interconnected by the latent flow path for flow of the latent working fluid between the first tank and the second tank through the heat exchanger, wherein the first tank comprises the latent working fluid at a temperature above its freezing point, and the second tank comprises ice slurry of the latent working fluid during operation;

wherein the method comprises during charging, pumping the latent working fluid from the first tank through the heat exchanger to the second tank in counterflow with the gas flow through the heat exchanger and transferring thermal energy from the water to the gas in the heat exchanger and forming ice slurry by the thermal energy transfer.

5. The method according to claim 4, wherein the temperature in the first tank is kept at ambient temperature due to heat exchange with the environment.

6. The method according to claim 2, wherein the latent TES system comprises an ice slurry tank and wherein the latent flow path is a latent flow circuit from the ice slurry tank to and through the heat exchanger and back to the ice slurry tank; wherein the method comprises pumping the latent working fluid from the ice slurry tank through the heat exchanger in counterflow with the gas flow through the heat exchanger and back to the ice slurry tank in a circuit during charging and during discharging.

7. The method according to claim 1, wherein the latent TES system is the only latent TES system in thermal connection with the gas flow circuit; and wherein the method comprises providing exchange of thermal energy between the gaseous working fluid and the latent working fluid only by heat exchange in the gas flow circuit at a position between the compressor/expander system and the bottom of the second TES container.

8. The method according to claim 1, wherein the TES containers are free from latent heat storage; and wherein the method comprises only providing sensible TES media in the TES containers.

9. The method according to claim 1, wherein the method comprises providing a further heat exchanger in the gas flow circuit between the bottom of the first TES container and the compressor/expander system, wherein the further heat exchanger exchanges thermal energy between the gas and an external fluid for changing a temperature of the external fluid.

10. The method according to claim 1, wherein the compressor and the expander are interconnected by a rotational shaft for synchronous motion, and wherein the method comprises driving the shaft by the motor during charging and driving the generator by the shaft during discharging.

11. The method according to claim 1, wherein the temperature $T_0$ of the latent working fluid is in a range of −20° C. and 0° C., and wherein the method comprises expanding the gas in the expander during charging to a temperature $T_e$ of at least 15° C. lower than $T_0$.

12. The method according to claim 1, wherein the method comprises raising the temperature of the gas by the compressor during the charging to a temperature above 400° C.

13. The method according to claim 1, wherein the first TES medium or the second TES medium or both are gas permeable and the method comprises creating a flow of the gas through the first TES medium or the second TES medium or both with direct contact between the gaseous working fluid and the first TES medium or the second TES medium or both.

14. The method according to claim 3, wherein the latent TES system comprises a first tank and second tank interconnected by the latent flow path for flow of the latent working fluid between the first tank and the second tank through the heat exchanger, wherein the first tank comprises the latent working fluid at a temperature above its freezing point, and the second tank comprises ice slurry of the latent working fluid during operation; wherein the method comprises during charging, pumping the latent working fluid from the first tank through the heat exchanger to the second tank in counterflow with the gas flow through the heat exchanger and transferring thermal energy from the water to the gas in the heat exchanger and forming ice slurry by the thermal energy transfer.

15. The method according to claim 14, wherein the temperature in the first tank is kept at ambient temperature due to heat exchange with the environment.

16. The method according to claim 3, wherein the latent TES system comprises an ice slurry tank and wherein the latent flow path is a latent flow circuit from the ice slurry tank to and through the heat exchanger and back to the ice slurry tank;

wherein the method comprises pumping the latent working fluid from the ice slurry tank through the heat exchanger in counterflow with the gas flow through the heat exchanger and back to the ice slurry tank in a circuit during charging and during discharging.

17. A thermal energy storage, TES, system, wherein the system comprises a thermodynamic gas flow circuit including a gaseous working fluid that is not in liquid phase but maintained in gas phase throughout the gas flow circuit;

a first TES container, wherein the first TES container has a top and a bottom and contains a first TES medium for storing thermal energy, the first TES medium having an upper end and a lower end, a second TES container, wherein the second TES container has a top and a bottom and contains a second TES medium for storing thermal energy, the second TES medium having an upper end and a lower end, an energy converter for converting between electrical energy and thermal energy of the gaseous working fluid in the gas flow circuit; the energy converter comprising an electrical motor, an electrical generator, and a compressor/expander system, the compressor/expander system comprising a compressor and an expander, wherein the compressor is functionally connected to the motor for being driven by the motor during a charging period, and the expander is functionally connected to the generator for driving the generator during a discharging period;

wherein the system for a charging period is configured for:

interconnecting the top of the first TES container and the top of the second TES container through the compressor and the bottom of the first TES container and second TES container through the expander, driving the compressor by the electric motor, receiving the gaseous working fluid from the top of the second TES container by the compressor, and adiabatically compressing the gaseous working fluid by the compressor for increasing a temperature of the gaseous working fluid, providing the compressed gaseous working fluid into the top of the first TES container and through the first TES medium for transferring heat from the gaseous working fluid to the first TES medium during movement of the gaseous working fluid from the top of the first TES container to the bottom of the first TES container, receiving the gaseous working fluid from the bottom of the first TES container by the expander and adiabatically expanding the gaseous working fluid for decreasing the temperature of the gaseous working fluid, after the expansion, receiving the gaseous working fluid by the bottom of the second heat exchanger, and by flow through the second TES medium towards the top of the second TES container transferring thermal energy from the second TES medium to the gaseous working fluid;

wherein the system for a discharging period is configured for:

interconnecting the top of the first TES container and the top of the second TES container through the expander and the bottom of the first TES container and the bottom of the second TES containers through the compressor, receiving the gaseous working fluid from the top of the first TES container by the expander and driving the generator for producing electrical power by work from the expander due to adiabatic expansion of the gaseous working fluid through the expander, guiding the gaseous working fluid from the expander into the top of the second TES container and through the second TES medium for transferring thermal energy from the gaseous working fluid to the second TES medium during movement from the top of the second TES container to the bottom of the second TES container, receiving and adiabatically compressing the gaseous working fluid by the compressor, after the compression, receiving the compressed gaseous working fluid at the bottom of the first TES container for transfer of thermal energy from the first thermal medium to the gaseous working fluid during its flow towards the top of the first TES container;

wherein the system comprises a latent TES system, the latent TES system comprising:

a latent fluid flow path containing a latent working fluid that comprises a phase change material and which is in the form of ice slurry during operation of the system, a heat exchanger located in the gas flow circuit between the compressor/expander system and the bottom of the second TES container, the heat exchanger separating the latent working fluid from the gaseous working fluid by a thermally conducting wall for exchange of thermal energy between the gaseous working fluid in the gas flow circuit and the latent working fluid in the latent flow path;

a pump for pumping the ice slurry through the heat exchanger and creating turbulence in the ice slurry during the transfer of the thermal energy in the heat exchanger;

wherein the system is configured for:

during the charging period, after adiabatic expansion of the gaseous working fluid by the expander, guiding the gaseous working fluid through the heat exchanger and transferring thermal energy from the latent working fluid to the gaseous working fluid for increasing the temperature of the gaseous working fluid before receiving the gaseous working fluid by the bottom of the second TES container, during the discharging period, guiding the gaseous working fluid from the bottom of the second TES container through the heat exchanger and transferring thermal energy from the gaseous working fluid to the latent working fluid prior to the adiabatic compression by the compressor.

* * * * *